US008313048B2

(12) United States Patent
Krause

(10) Patent No.: US 8,313,048 B2
(45) Date of Patent: Nov. 20, 2012

(54) FUEL INJECTOR

(75) Inventor: Andreas Krause, Unterriexingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/308,290

(22) PCT Filed: Sep. 13, 2007

(86) PCT No.: PCT/EP2007/059611

§ 371 (c)(1),
(2), (4) Date: May 5, 2010

(87) PCT Pub. No.: WO2008/052840

PCT Pub. Date: May 8, 2008

(65) Prior Publication Data

US 2010/0282872 A1 Nov. 11, 2010

(30) Foreign Application Priority Data

Oct. 31, 2006 (DE) ..... 10 2006 051 327

(51) Int. Cl.
*F02M 61/00* (2006.01)

(52) U.S. Cl. ..... 239/533.12; 239/596; 239/585.1; 239/500; 239/599; 239/518

(58) Field of Classification Search ..... 239/533.12, 239/500, 502, 518, 596, 599, 585.1
See application file for complete search history.

(56) References Cited

U.S. PATENT DOCUMENTS

| | | | | |
|---|---|---|---|---|
| 4,979,479 | A * | 12/1990 | Furukawa | 123/472 |
| 5,649,665 | A * | 7/1997 | El-Darazi et al. | 239/533.3 |
| 6,019,296 | A * | 2/2000 | Yamamoto et al. | 239/533.2 |
| 6,915,968 | B2 * | 7/2005 | Abe et al. | 239/585.1 |
| 7,159,802 | B2 * | 1/2007 | Oomura et al. | 239/596 |
| 2003/0155449 | A1 | 8/2003 | Abe et al. | |
| 2004/0046064 | A1 | 3/2004 | Shiraishi et al. | |

FOREIGN PATENT DOCUMENTS

| | | |
|---|---|---|
| DE | 198 15 789 | 10/1999 |
| DE | 10 2005 036951 | 2/2007 |
| EP | 1 195 515 | 4/2002 |
| EP | 1 335 129 | 8/2003 |
| JP | 11 148446 | 6/1999 |
| JP | 2002-503314 | 1/2002 |
| JP | 2002-115625 | 4/2002 |
| JP | 2004-100536 | 4/2004 |

* cited by examiner

*Primary Examiner* — Dinh Q Nguyen
*Assistant Examiner* — Viet Le
(74) *Attorney, Agent, or Firm* — Kenyon & Kenyon LLP

(57) ABSTRACT

A fuel injector, in particular for direct injection of fuel into a combustion chamber of an internal combustion engine, has a valve needle, which is situated in a nozzle body and is operable by an actuator, and a valve closing body, which is operatively connected to the valve needle and, for opening and closing the valve, cooperates with a valve seat face formed on a valve seat body, the valve seat body being provided with at least one spray hole. The at least one spray hole has a first cylindrical section having a fuel inlet opening and a second cylindrical section situated downstream from the first cylindrical section and having a fuel outlet opening, the first and the second cylindrical sections not running coaxially to one another.

10 Claims, 4 Drawing Sheets

A - A

A - A

A - A

FUEL INJECTOR

FIELD OF THE INVENTION

The present invention is directed to a fuel injector.

BACKGROUND INFORMATION

Cylindrical spray holes are usually provided in fuel injectors currently in use for direct gasoline injection for preparing the fuel mixture. Stepped spray holes are currently used to protect the spray hole from deposits and to achieve a shortening of the spray hole at a constant spray hole disk thickness.

Patent document WO 02/084104 A1 discusses a fuel injector for fuel injection systems of internal combustion engines, which includes a magnet coil, a valve needle that is operatively connected to the magnet coil and is acted upon in the closing direction by a restoring spring for operating a valve closing body, which forms a sealing seat together with a valve seat face formed on a valve seat body, and at least two spray discharge openings formed in the valve seat body. The spray discharge openings are formed in the valve seat body in such a way that they are shielded from the circulating flows of mixture in a combustion chamber of the internal combustion engine and therefore have a cylindrical spray discharge hole and a ring wall adjacent thereto, the latter wall being high enough to shield each of the spray discharge openings from the flows circulating in the combustion chamber.

To achieve an increase in spray angle, it is also known in the related art that the length/diameter ratio of the spray hole may be reduced, but the reduction in length of the spray hole is limited due to the associated decline in strength of the spray hole disk.

In addition, for manifold injection, valves having trumpet-shaped spray holes are used, imparting a high transverse movement to the stream already within the spray hole and thereby allowing rapid and good atomization. This also achieves an increase in the spray angle, but with moderate stream stability. With such a configuration, the stream angle depends greatly on the oncoming flow ratios.

With the valves described above, there is the disadvantage that the mixture is processed via a turbulent, approximately cylindrical free jet having a relatively low surface/volume ratio.

Furthermore, valves for low-pressure spraying, having conical spray holes at a great inclination, are also known. Since the mass spray-discharged as a thin film atomizes much better than the main jet, there is an improvement in SMD on the whole, but this geometry is not suitable for fuel injectors having stepped spray holes, and the cross-flow, which is created primarily by angle $\phi$ of inclination of the spray hole, is necessarily coupled to spray discharge angle $\gamma$.

SUMMARY OF THE INVENTION

Against this background, the fuel injector according to the present invention having the characterizing feature of the main claim has the advantage that an improvement in SMD, in particular for manifold injectors, is achieved and with the configuration according to the exemplary embodiments and/or exemplary methods of the present invention, there is the possibility of increasing the spray angle in high-pressure injectors to be able to further reduce jet penetration into the combustion chamber. In comparison with the valve described above, the cross-flow required for the principle used for jet widening is not necessarily linked to spray discharge angle $\gamma$.

The configuration of the spray hole according to the present invention may advantageously be used in fuel injectors already manufactured with stepped spray holes, only a corresponding modification of the hole axes being required.

It is advantageous in particular that the principle of jet preparation according to the present invention as described above is made possible by using manufacturing methods that have already been established.

Furthermore, it is advantageous that in comparison with the valves of the related art described above, not only is a turbulent cylindrical free jet generated, which atomizes relatively poorly or atomizes well only when high pressures are applied, but also a certain portion of the fuel flow is spray-discharged in the form of a thin lamella which is atomized well.

Another advantage of the fuel injector according to the present invention is that the circumferential direction of the fluid produces an additional widening of the jet beyond the geometric angle on leaving the spray hole much like that which occurs with a spiral valve.

An exemplary embodiment of a fuel injector according to the related art, an exemplary embodiment of a valve seat element according to the related art, and a valve seat element of a fuel injector according to the present invention are shown in simplified form in the drawings and are explained in greater detail in the following description.

DETAILED DESCRIPTION

Figure 1:
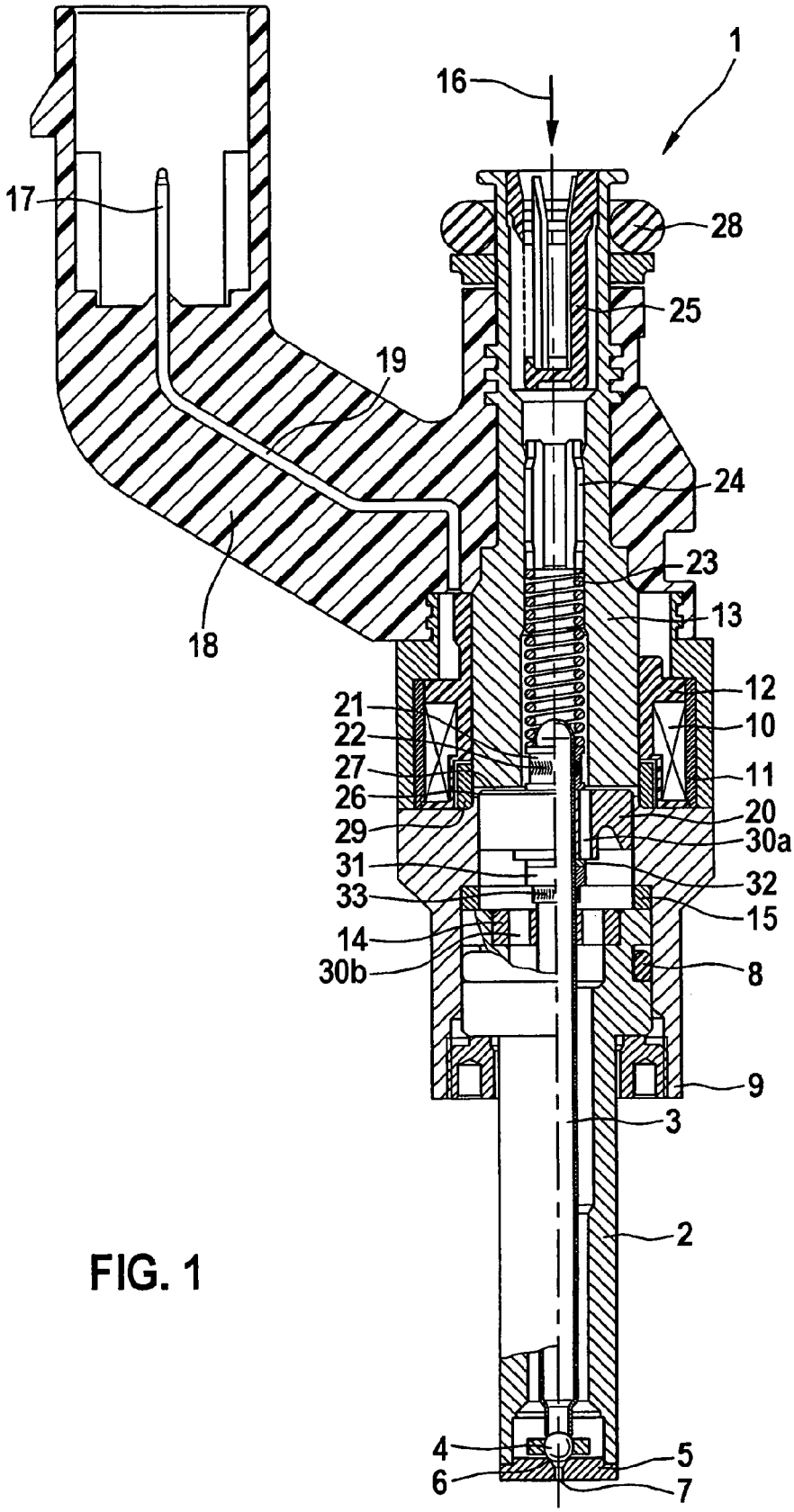
FIG. 1 shows a schematic cross section through a fuel injector according to the related art.

FIG. 1 shows a schematic cross section through a fuel injector 1 according to the related art, according to which the essential components of the valve are to be explained briefly.

Fuel injector 1 is in the form of a fuel injector for fuel injection systems of internal combustion engines having compression of a fuel/air mixture and spark ignition. Fuel injector 1 is suitable in particular for direct injection of fuel into a combustion chamber (not shown) of an internal combustion engine.

Fuel injector 1 has a nozzle body 2 in which a valve needle 3 is situated. Valve needle 3 is operatively connected to a valve closing body 4 which cooperates with a valve seat face 6 on a valve seat body 5 to form a sealing seat. Fuel injector 1 in the exemplary embodiment is an inwardly opening electromagnetically operable fuel injector 1 having a spray hole 7. Nozzle body 2 is sealed by a gasket 8 against external pole 9 of a magnet coil 10. Magnet coil 10 is encapsulated in a coil casing 11 and wound onto a field spool 12, which is in contact with inside pole 13 of magnet coil 10. Internal pole 13 and external pole 9 are separated from one another by a gap 26 and are supported on a connecting component 29. Magnet coil 10 is energized via a line 19 by an electric current suppliable via an electric plug contact 17. Plug contact 17 is surrounded by plastic sheathing 18, which may be integrally molded on internal pole 13.

Valve needle 3 is guided in a valve needle guide 14 designed in the form of a disk. A paired adjusting disk 15 is used for adjusting the lift. On the other side of adjusting disk 15, an armature 20 is connected via a first flange 21 in a force-fitting manner to valve needle 3, which is in turn connected to the first flange by a weld 22. A restoring spring 23, prestressed by a sleeve 24 in the present design of fuel injector 1, is supported on first flange 21. A second flange 31, also connected by a weld 33 to valve needle 3, functions as the lower armature stop. An intermediate elastic ring 32, sitting on second flange 31, prevents an impact when closing fuel injector 1.

Fuel channels 30*a*, 30 carrying the fuel supplied through a central fuel feed 16 and filtered through a filter element 25 to spray hole 7 in valve seat body 5 run in valve needle guide 14, in armature 20 and in valve seat body 5. Fuel injector 1 is sealed by a gasket 28 against a distributor line (not shown).

In the resting state of fuel injector 1, armature 20 is acted upon by restoring spring 23 against its direction of lift via first flange 21 at valve needle 3, so that valve seat body 4 is held in sealing contact with valve seat face 6. On excitation of magnet coil 10, it builds up a magnetic field which moves armature 20 in the lifting direction against the spring force of restoring spring 23, the lift being predefined by a working gap 27 between internal pole 13 and armature 20 in the resting position. Armature 20 entrains first flange 21, which is welded to valve needle 3, and thus also entrains valve needle 3 in the direction of lift. Valve closing body 4, operatively connected to valve needle 3, lifts up from valve seat face 6 and the fuel reaching spray hole 7 through fuel channels 30*a*, 30*b* is spray-discharged. When the coil current is turned off, after the magnetic field has weakened sufficiently, armature 20 falls away from internal pole 13 due to the pressure of restoring spring 23 on first flange 21, thereby moving valve needle 3 against the direction of lift. Valve closing body 4 therefore sits on valve seat face 6 and fuel injector 1 is closed.

Figure 2A:
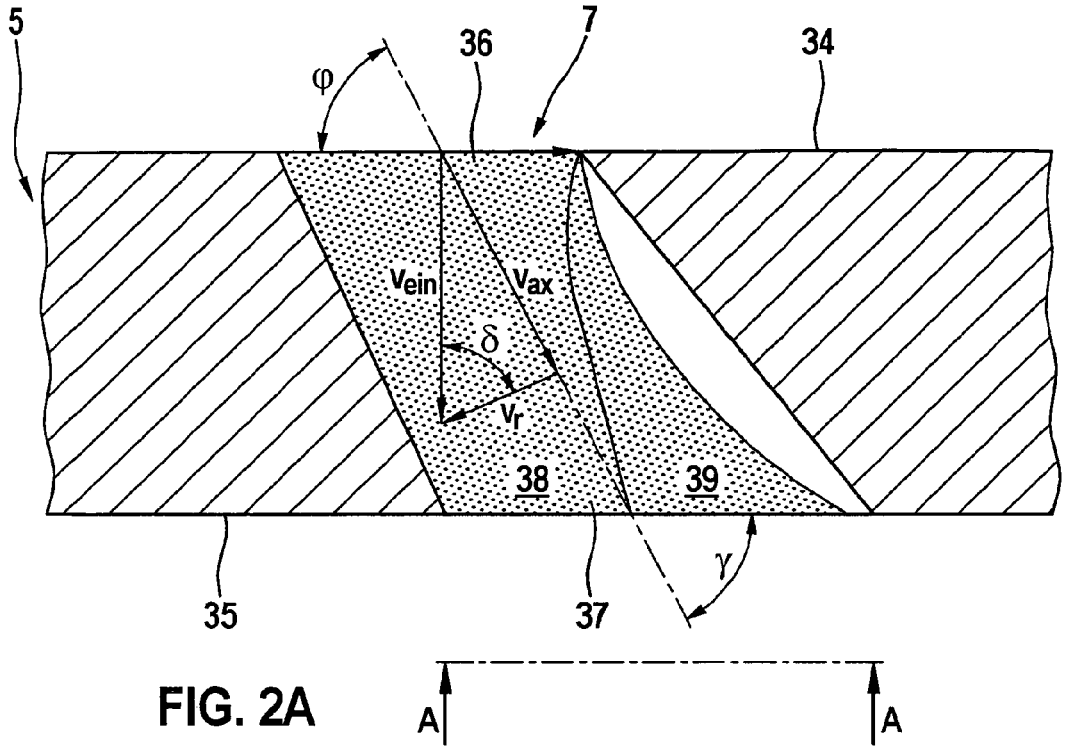
FIG. 2*a* and FIG. 2*b* show a schematic cross section through a valve seat body according to the related art and/or an illustration of a jet geometry created by the spray hole along line A-A in FIG. 2*a*.
Figure 2B:
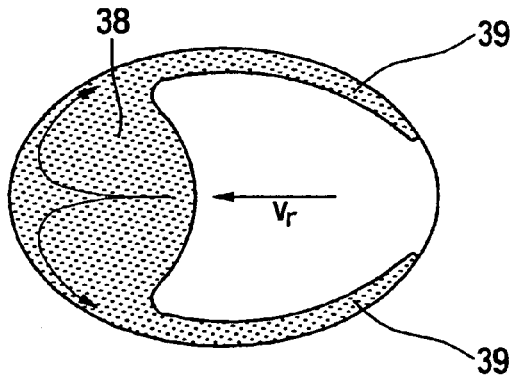

FIG. 2*a* shows a schematic cross section through a valve seat body 5 according to the related art. Valve seat body 5 has an, end face 34 on the inlet end and an end face 35 on the outlet end opposite the former. On end face 34 on the inlet end, spray hole 7 running obliquely thereto at an angle $\phi$ formed with it enters valve seat body 5 through an inlet opening 36 and exits on end face 35 on the spray discharge side at an angle $\gamma$, which forms the longitudinal axis of spray hole 7 with end face 35. Spray hole 7 thus has a conical shape and a great inclination. Angle of inclination $\gamma$ or $\phi$ of the spray hole results in separation of flow at the spray hole inlet, thus forming a two-phase flow in the spray hole. In addition, inlet flow $v_{ein}$ is divided into an axial component $v_{ax}$ and a radial component $v_r$. The angle between $v_{ein}$ and $v_{ex}$ ($90°-\delta$) is formed primarily by angle $\phi$ but may also be reduced or increased by a forced oncoming cross-flow to the hole and thus a change in direction of $v_{ein}$. Velocity component $v_r$ inclined perpendicular to the wall of the spray hole is converted into a circumferential component, resulting in buildup of a thin film in the part of the spray hole filled with air. The remainder of the flow-through is spray discharged as an approximately cylindrical main jet 38 through the other valves. Since the mass spray-discharged as a thin film 39 atomizes much better than main jet 38, the overall result is an improvement in SMD, but the oncoming cross-flow, which is necessary for this principle and is created primarily by angle of inclination of spray hole 7, is linked to spray discharge angle $\gamma$. The jet geometry along line A-A in FIG. 2*a* created by this configuration is shown in a top view of the jet geometry in FIG. 2*b*.

Figure 3A:
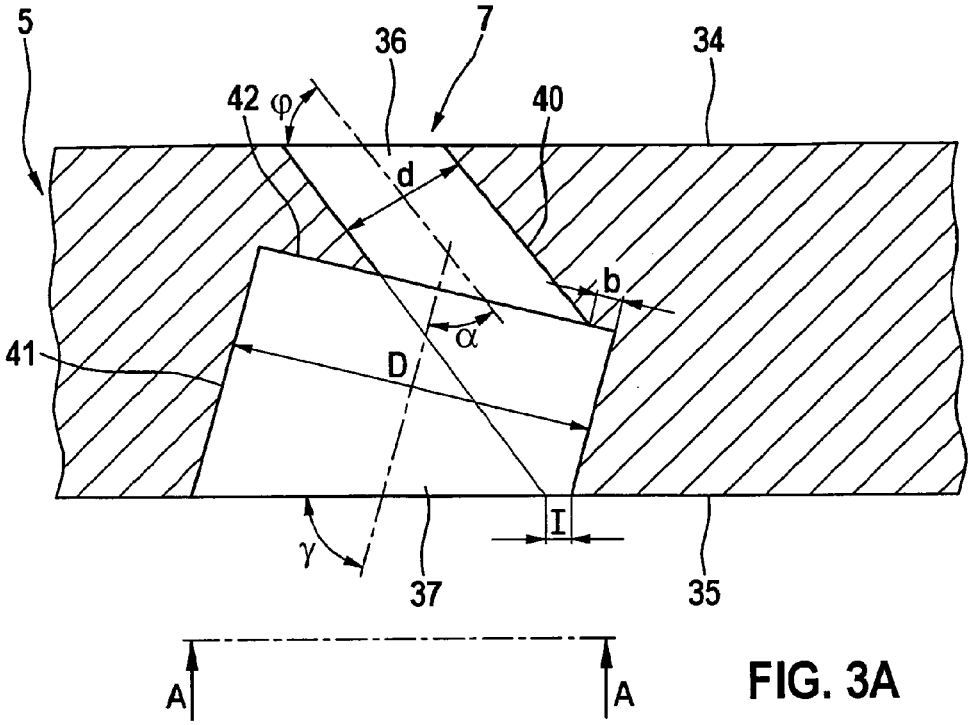
FIG. 3*a* and FIG. 3*b* show a schematic cross section through a valve seat body according to the present invention and/or an illustration of a spray hole geometry along line A-A from FIG. 3*a*.

FIG. 3*a* shows a schematic cross section through a valve seat body 5 according to the present invention. Valve seat body 5 has a spray hole 7 which enters into valve seat body 5 on its end face 34 on the oncoming flow side and emerges from the end face 35 on the spray discharge side. Spray hole 7 has a first cylindrical section 40 and a second cylindrical section 41, which are not situated coaxially. Instead, inlet opening 36, i.e., a longitudinal axis of first cylindrical section 40, forms an angle $\phi$ with end face 34 on the oncoming flow side, this angle characterizing the inlet angle of the fuel flow into spray hole 7. Outlet opening 37, i.e., the longitudinal axis of second cylindrical section 41, forms an angle $\gamma$ with end face on the spray discharge side of valve seat body 5.

In addition, a spray hole inlet, i.e., inlet opening 36, has a cylinder of diameter d and a spray hole outlet, i.e., outlet opening 37, has a cylinder of diameter D, which is larger than diameter d. The longitudinal axis of first cylindrical section and the longitudinal axis of second cylindrical section 41 are inclined at an angle $\alpha$ to one another. Angle $\alpha$ controls the ratio in which the fluid flow of velocity v in the outlet cylinder, i.e., in second cylindrical section 41, this fluid flow passing axially through the inlet cylinder, i.e., first cylindrical section 40, is converted into a radial component ($v_r$) and thus a circumferential component ($v_u$). This is even more the case, the greater the angle $\alpha$ between the two longitudinal axes is.

Figure 3B:
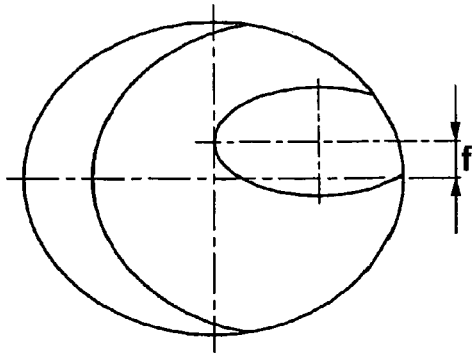

Angle $\gamma$ defines the spray discharge angle, which may be varied at a constant $\alpha$ and thus without any negative effect on function. Only inlet angle $\phi$ changes here. The amount of cutoff I is ideally as close as possible to being equal to or less than zero. This requirement is most easily met when b is zero, i.e., when a section of a lateral surface of first cylindrical section 40 is adjacent to a section of a lateral surface of second cylindrical section 41 and another section of a lateral surface of first cylindrical section 40 is adjacent to a cover surface 42 of second cylindrical section 41. FIG. 3*b* shows a sectional view along line A-A in FIG. 3*a*. It may be seen here that the two cylinder axes do not, i.e., need not, lie in one plane but instead have a lateral offset f. As f is greater, there is an increasingly irregular distribution of mass flow onto the two lamellas or onto film 39.

Figure 4A:
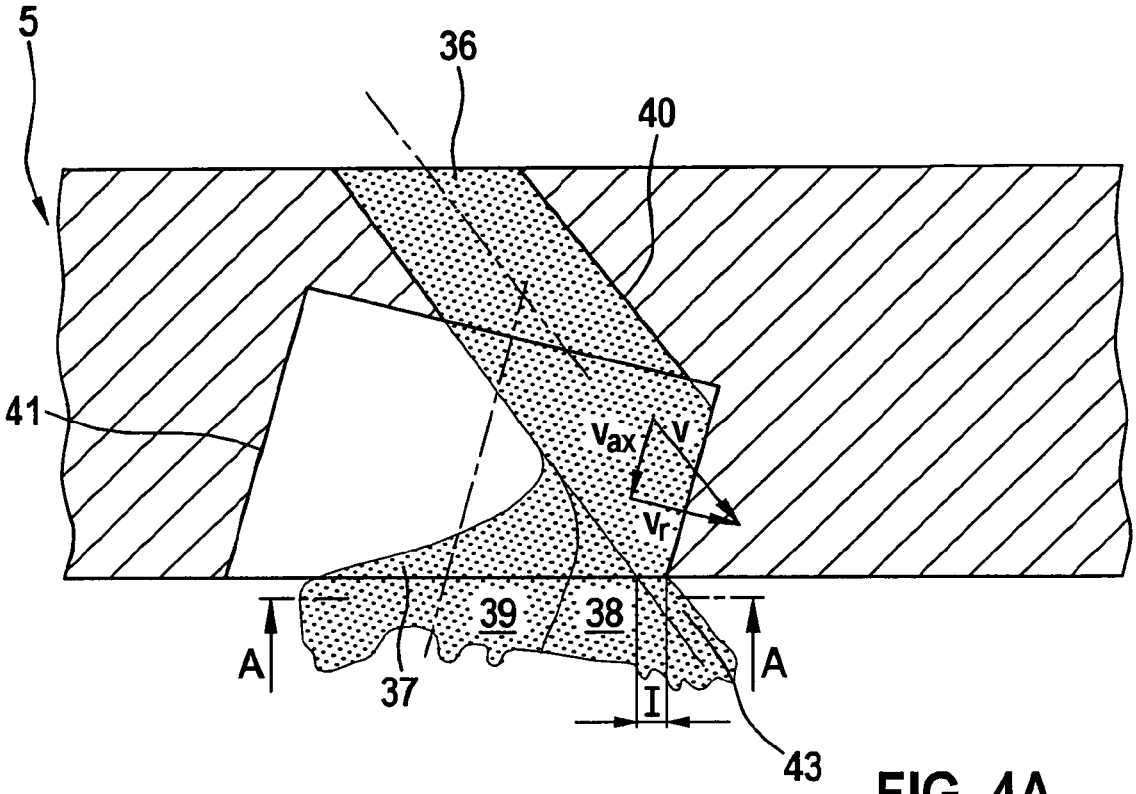
FIG. 4*a* and FIG. 4*b* show a schematic cross section through the valve seat body according to the present invention and/or an illustration of the jet geometry created along line A-A from FIG. 4*a*.
Figure 4B:
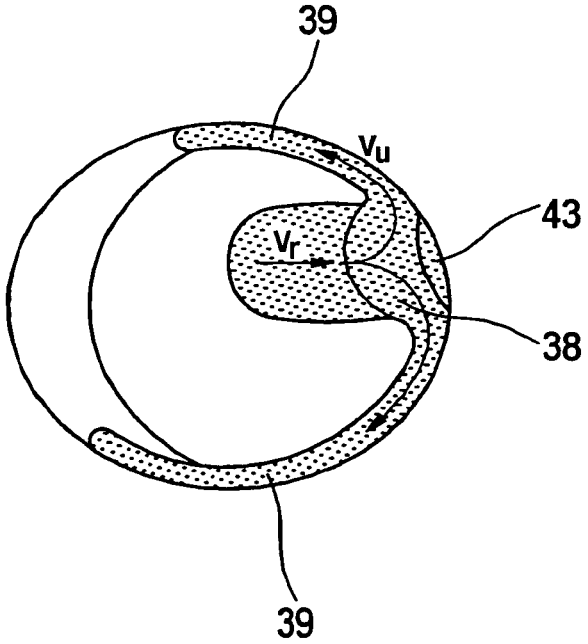

The flow principle according to the exemplary embodiments and/or exemplary methods of the present invention is illustrated again in FIGS. 4*a* and 4*b*. In particular when the amount of cutoff I is not equal to zero, a portion of the stream is sprayed at a spray discharge angle equal to inlet angle $\phi$, i.e., the direction of v, and forms a side stream which is characterized with reference numeral 43 in FIGS. 4*a* and 4*b*. This portion is not used to create the lamellas, i.e., thin film 39. The velocity component of velocity vector v running parallel to the longitudinal axis of second cylindrical section 41 ($v_{ax}$) is spray-discharged coaxially to section 41 primarily as a main jet and/or free jet 38. Velocity component $v_r$ is partially converted to velocity component $v_u$ and functions to build up lamellas 39 or thin film 39. After the lamellas leave spray hole 7 on the spray discharge end of outlet opening 37 of the second cylindrical section 41 of spray hole 7, a radial component resulting in an increased fanning out of the jet is created again due to the centrifugal force built up due to the circumferential component.

What is claimed is:

1. A fuel injector for directly injecting fuel into a combustion chamber of an internal combustion engine, comprising:

a valve needle situated in a nozzle body and operable by an actuator;

a valve seat body having at least one spray hole; and a valve closing body operatively coupled to the valve needle and cooperating with a valve seat face for opening and closing the valve, the valve seat face being formed on the valve seat body;

wherein the at least one spray hole has a first cylindrical section with a fuel inlet opening, and a second cylindrical section, situated downstream from the first cylindrical section, having a fuel outlet opening, the first and second cylindrical sections not running coaxially to one another, such that the fuel injector is configured to impart first and second circumferential flows to a fuel stream passing therethrough, the first and second circumferential flows flowing in respective first and second rotational directions along a circumference of the second cylindrical section, the first direction being opposite the second direction, the axes of the first and second cylindrical sections being non-coplanar such that the fuel injector is configured to provide a difference in mass flow between the first circumferential flow and the second circumferential flow.

2. The fuel injector of claim 1, wherein the particular longitudinal axes of the first cylindrical section and of the second cylindrical section are inclined at an angle to one another.

3. The fuel injector of claim 1, wherein the fuel inlet opening has a diameter which is smaller than a diameter of the fuel outlet opening.

4. The fuel injector of claim 1, wherein the longitudinal axis of the second cylindrical section is inclined at an angle with respect to an end face of the valve seat body on the spray discharge side.

5. The fuel injector of claim 1, wherein the longitudinal axis of the first cylindrical section is inclined by an angle with respect to an inlet-side end face of the valve seat body, this angle characterizing the fuel inlet angle.

6. The fuel injector of claim 1, wherein an amount of cutoff is one of equal to, less than, or greater than zero.

7. The fuel injector of claim 1, wherein a lateral surface section of the cylinder wall of the first cylindrical section is adjacent to a lateral surface section of the cylinder wall of the second cylindrical section and another lateral surface section of the cylinder wall of the first cylindrical section is adjacent to a section of the cover face of the second cylinder section.

8. The fuel injector of claim 1, wherein the entire lateral surface of the cylinder wall of the first cylindrical section is adjacent to the cover face of the second cylindrical section.

9. The fuel injector of claim 1, wherein all or part of the spray-discharged fuel jet is output as a thin lamella and in the second case, the remainder is output as a turbulent cylindrical free jet.

10. The fuel injector of claim 1, wherein the axes of the cylinders are at an angle greater than zero.

* * * * *